United States Patent [19]

Garcin et al.

[11] 4,163,520

[45] Aug. 7, 1979

[54] ELECTROSTATIC LIQUID SPRAYING NOZZLE

[75] Inventors: Felix Garcin, Grenoble; Marcel Weil, Saint-Martin-d'Heres, both of France

[73] Assignee: Air Industrie, Courbevoie, France

[21] Appl. No.: 906,761

[22] Filed: May 16, 1978

Related U.S. Application Data

[63] Continuation of Ser. No. 702,422, Jul. 6, 1976, abandoned.

[51] Int. Cl.[2] ..... B05B 5/00

[52] U.S. Cl. ..... 239/707

[58] Field of Search ..... 239/3, 690, 692, 697, 239/698, 704, 706, 707, 15

[56] References Cited

U.S. PATENT DOCUMENTS

| | | | |
|---|---|---|---|
| 3,233,831 | 2/1966 | Fraser | 239/15 |
| 3,795,839 | 3/1974 | Walberg | 239/15 X |

*Primary Examiner*—Richard A. Schacher

*Attorney, Agent, or Firm*—Brisebois & Kruger

[57] ABSTRACT

An air-assisted electrostatic round-spray nozzle for liquids, wherein, except for the charging electrode(s), the diffuser, as also the whole of the outer part of the nozzle, is made of electrically insulating material, and whereon the said electrode(s) is/are formed by one or more points or p-n-point zones located substantially in the atomizing plane, on or very near the axis of the nozzle.

6 Claims, 2 Drawing Figures

ELECTROSTATIC LIQUID SPRAYING NOZZLE

This is a continuation of application Ser. No. 702,422, filed July 6, 1976 and now abandoned.

The present invention relates to an air-assisted electrostatic round-spray nozzle intended to spray liquid products, for instance paints or enamels. Such nozzles are well-known by the man of the art and equip, or have equipped, certain types of manual guns of the applicant, such as, for example, the guns sold at present under the reference "Statair MRV 66" or sold formerly under the reference "Statair K". They are either described or represented in numerous publications, such as, for example the French patents published under Pat. Nos. 1,358,199, 1,366,864, 1,394,834, 1,537,997, 2,050,317, 2,052,003, 2,053,425, 2,102,675, 2,115,663, 2,120,393. They comprise:

- at least one charging electrode made of electrically conductive material, brought to high voltage and generally located at the downstream end of the nozzle;
- a "diffuser" intended to shape the incident stream of liquid, before atomization, into a liquid thin-walled tube, or tubular film. It is only in fact due to this shaping into a thin tubular film of large diameter that it is possible to obtain, with a round-spray nozzle, satisfactory spraying with industrially acceptable flow rates of paint and air;
- a part known as the "insert" surrounding the said diffuser so as to leave a slight tubular space filled with liquid;
- at least one atomizing gas outlet; this is generally a ring-shaped space surrounding the downstream end of the insert, and giving a swirling spray according to French Pat. No. 1,366,864. Such a nozzle is placed at the end of an electrostatic spray-gun. It is advantageous to connect the part forming the electrode to high voltage through a high value resistor, generally embedded in the barrel of the gun, as taught by French Pat. No. 1,198,405. Such a resistor has the effect of regulating the field between the nozzle and the object when their distance varies, and provides in addition appreciable protection against accidental discharges from the capacity of the cable connecting the gun to the high voltage generator, discharges which would give rise to violent sparks liable to cause a fire.

The presence of such a resistor does not exclude, however, the possibility of an accidental discharge from the capacity of the part under voltage located between the downstream end of the resistor and the downstream end of the electrode, which here we always suppose to be placed at the end of the gun, called "end capacity".

However small this end capacity is made to be, it may not easily be made as low as could be wished. Consequently, whenever the painter brings the gun near the object, this operation is bound to cause a spark, whose discharge energy may be dangerous.

In order to cut down as far as possible this discharge energy, an effort has always been made, with such nozzles, to reduce as much as possible the end capacity. The latest production of the applicant, corresponding to the recently marketed "Statair MRV 66" gun, has the gun equipped with a nozzle which is entirely insulating, apart from the metal insert, which is small-sized and brought to high voltage through a high protective resistor embedded in the barrel of the gun. The annular film of paint is, in such nozzles, charged by contact with the insert. However small the end capacity of such nozzles, their discharge energy, usually measured when no spraying is taking place, has proved, in certain cases, to be still too great in the eyes of particularly demanding customers.

The air-assisted electrostatic round-spray nozzle according to the invention makes it possible to obtain a discharge energy, measured when no spraying is taking place, which is distinctly reduced in comparison with that of the nozzles with end metal electrode(s) existing at present. It is characterized in that, except for the said charging electrode(s), the diffuser, the insert, together with the whole of the outer part of the nozzle, are made of electrically insulating material, and in that the said electrode(s) are formed by one or more points or pin-point zones located substantially in the atomization plane and inside the liquid thin-walled tube formed in the space between the insert and the diffuser.

By "atomization plane" is meant the plane through which the liquid passes—or begins to pass—from the continuous liquid phase to the discontinuous phase, i.e. to transformation into droplets. In practice, with a round-spray nozzle, this plane is generally the front side of the nozzle, or very slightly in front of the said front side. By "substantially" in the atomization plane is meant preferentially in the atomization plane, but without excluding a very slight displacement forwards or backwards from the plane; the said displacement may be a fraction of a millimeter, or even a millimeter, while still remaining within the scope of the invention: the atomization plane may not, in fact, be fixed to the exact millimeter.

By "pin-point zone" is meant a zone of very small diameter, and in any case hardly bigger than a pin-head.

The invention will be clarified in the following description of a preferential example of construction, with reference to the annexed drawings, in which.

Figures 1, 2:
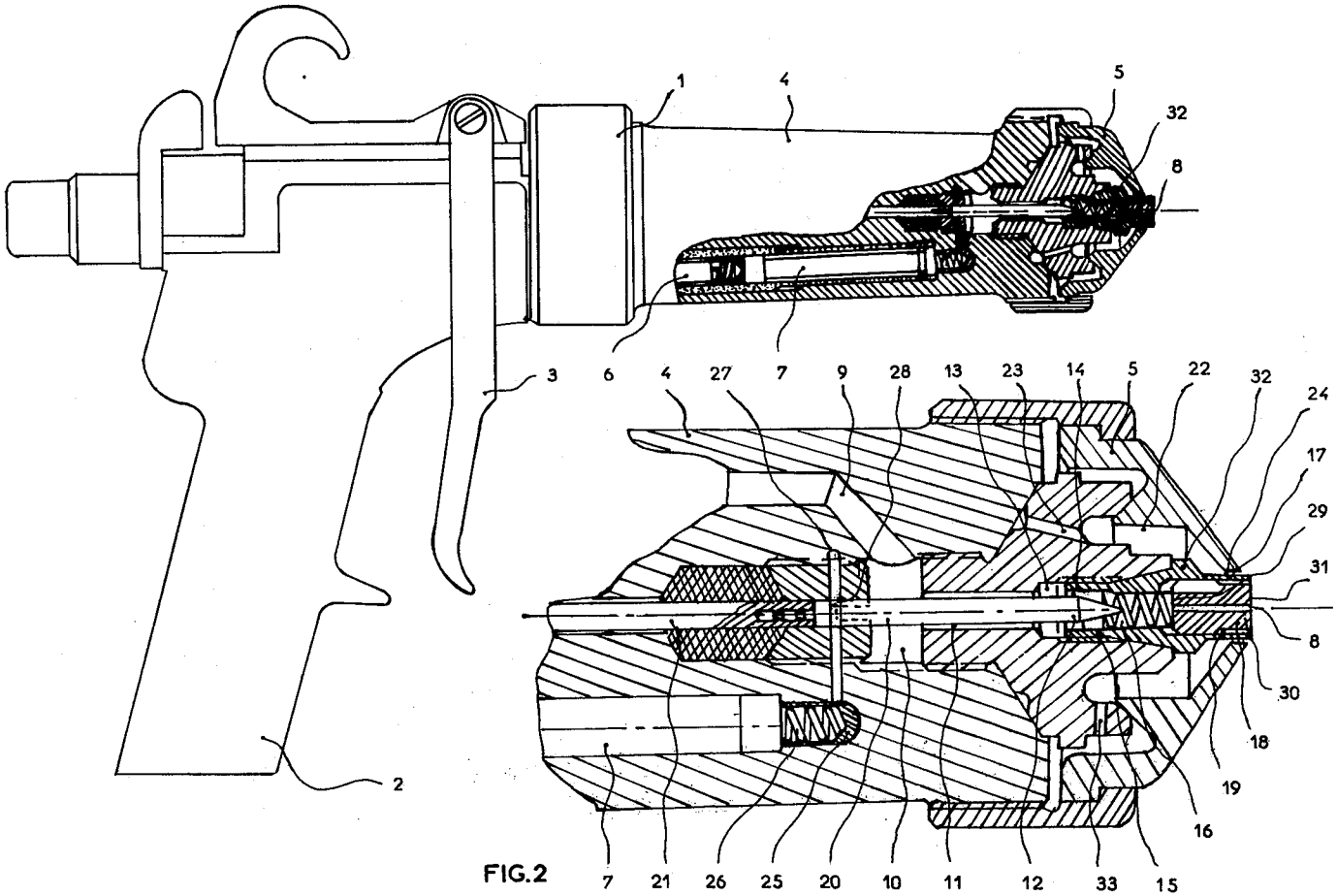
FIG. 1 shows diagrammatically a manual electrostatic round-spray paint gun, equipped with a nozzle according to the invention.
FIG. 2 shows an enlarged view of the nozzle equipping the gun of FIG. 1.

On FIG. 1, numeral (1) refers to a manual electrostatic paint-gun strictly identical, apart from its nozzle which is the subject of the invention, to the round-spray guns at present sold by the applicant under the reference MRV 66. It has, as known per se, a hand grip (2), a trigger (3), an insulating barrel (4) and an atomizing nozzle (5). The paint and compressed air intakes, as also the high voltage cable, have not been shown on the drawing, being conventional. There may be distinguished, however, the downstream end (6) of the high voltage cable, as also the high value resistor (7), for example a hundred or so megohms with a high voltage of 60 kilovolts, embedded in the barrel (4) of the gun, in series between the inlet (6) of the high voltage cable and the metal charging electrode (8) placed at the end of the gun.

On FIG. 2, where there is an enlarged view of the downstream end of the gun (1) equipped with the nozzle (5) according to the invention screwed on to the end of the barrel (4), there may be recognized:

(1) a circuit bringing the paint comprising:

a paint intake tube (9);

a distribution chamber (10) followed by an axial tube (11) in which a pin-valve (12) can slide leaving sufficient room for the paint to pass freely;

two small chambers (13) and (14) placed in series with tube (11) and ending with the seating (15) of the pin-valve (12), the whole (12, 15) forming a valve opening and closing paint intake at the nozzle;

a transition tube (16) bringing the paint towards the injector (32) properly speaking, formed by an insert (17) and a diffuser (18) leaving between them a thin ring-shaped space (19) necessary for creating the thin tubular film of paint which is to be atomized by the stream of compressed air.

All these parts are made of insulating material, except part (15) and except the pin (12) formed by a metal end (20) fixed into an insulating rod (21).

(2) a compressed air circuit comprising:

an annular chamber (22), with, as known per se, tangential air intakes (33) and direct air intakes (23);

an atomization air outlet ring (24), narrowly surrounding the downstream end of the paint injector (32).

(3) a high voltage circuit comprising:

a metal part (25) connecting the resistor (7), incorporating a metal spring (26);

a metal part (27) with a hole (28) very narrowly surrounding the pin (12) and thus ensuring the electrical connection between part (25) and the metal front part (20) of the said pin;

the front part (20) of the needle (12), remaining, when no spraying is taking place, on its metal seating (15): when the gun is functioning, the pin (12) is slightly withdrawn, the electrical connection between the downstream end of the said pin (12) and the seating (15) then being ensured by the paint, which is always at least slightly conductive.

a metal spring (29) ensuring the electrical connection between the seating (15) of the pin and a fine metal wire (30) crossing axially, through and through, the insulating diffuser (18) and ending up, according to the invention, exactly in the downstream plane (31) of the diffuser (18), so as to create there a pin-point electrode (8).

Although it is not absolutely compulsory, the strictly axial position of the pin-point electrode (8) is preferred for several reasons: it is first of all advantageous to be entirely symetric on all sides from the point of view of protection against sparks: in this way, distance from the electrode (8) is always the same, however the painter brings the gun near the earthed object. If, for example, the pin-point electrode (8) was displaced upwards, a spark of low energy would in fact be obtained when an earthed object is approached from above, but on the contrary a spark of stronger energy would be obtained when an earthed object is approached from underneath, as explained previously. It is therefore preferable, through not absolutely compulsory so long as the electrode remains within the ring delimiting the front side (31) of the diffuser, i.e. within the annular tube of paint (19), to place said electrode (8) exactly in the axis of the nozzle.

Furthermore, it is well known that the front side (31) of the diffuser (18) is, when operating, permanently covered by capillarity with a film of paint forming a continuous link with the tubular film (19). The electrode (8) of the invention is thus covered by this film, so that the electric charging of the paint takes place by conduction through it, which is generally more effective than charging by bombardment according to the devices of French Pat. No. 1,285,345; here again, the electric charge of the paint will be distributed more symetrically if the electrode (8) is axial and not off the axis.

It is obviously absolutely necessary for the electrode (8) of the invention to be inside the annular film of paint (19), i.e. to be situated on the front side (31) of the diffuser (18) itself; otherwise, there could obviously be no charging by conduction, and, on the other hand, the man of the art is well aware that pin-point electrodes placed outside the ring of paint tend, no doubt on account of the parasitic concentration of lines of force they produce, to cause dirty marks both on the nozzle, gun and painter, and tend furthermore to perturb, for the same reasons, the electrostatic charging of the paint.

In the example of construction described, it has been supposed—this being the most simple construction—that the pin point electrode (8) was connected to high voltage by a simple wire (30), of which it forms the downstream end. Of course, to satisfy still more demanding customers, the wire (18), and possibly all or part of spring (29), could very well be replaced by an electrical resistor of moderate value, for example from 0.5 to 5 megohms, the downstream end of its connection wire forming the electrode.

Only one pin-point electrode (8) has been shown on the drawing, for this corresponds to the simplest construction and is thus to be preferred. It is evidently likewise possible to have several pin-point electrodes placed in the downstream plane (31) of the diffuser (18), while still remaining in the scope of the invention. Experimentally, the applicant has produced an electrode formed by a star-shaped cluster of points situated in plane (31): for this, wire (30) was replaced by an electrical wire formed by a score of wires of very small diameter being twisted together. The so-formed wire was made to project 2 millimeters beyond the plane (31); then the said projecting part was crushed into a star shape, so as to obtain a cluster of fine needles situated within the said plane: the results obtained both in spark tests and in electrostatic spraying were not appreciably different from those obtained in the preferential construction described with reference to FIGS. 1 and 2.

The nozzle according to the invention may be used on all types of electrostatic liquid spraying guns, either manual or automatic. It is used most advantageously in the electrostatic paint and enamelling industry.

What we claim is:

1. An air-assisted electrostatic round-spray nozzle which defines an outlet for a liquid to be sprayed and comprises:

at least one charging electrode made of electrically conductive material and means for connecting said electrode to a source of high voltage, diffuser means of electrically insulating material for shaping the liquid to be sprayed into a thin-walled tube before it emerges from said nozzle, said diffuser means being within said thin walled tube and having a downstream end, at least one outlet for atomizing gas adjacent said outlet for liquid to be sprayed, and wherein all exposed portions of said nozzle, except for a downstream end of said at least one electrode, are of electrically insulating material, said downstream end of said at least one electrode comprises at least one point exposed at the downstream end of the diffuser means, said thin-walled liquid tube having a downstream portion which encircles and has the interior of its wall spaced from said downstream end of said at least one electrode, and the downstream end of said at least one electrode is located substantially in the atomizing plane of said nozzle.

2. An electrostatic nozzle according to claim 1 wherein said downstream end of said at least one electrode comprises a plurality of points, and the downstream end of said liquid tube has its wall encircling and spaced outwardly of said points.

3. Spray nozzle as claimed in claim 1 wherein said downstream end of said electrode comprises a single electrode formed by the end of an electrically conductive wire.

4. Spray nozzle as claimed in claim 3 in which said electrode is positioned axially of said liquid outlet.

5. Spray nozzle as claimed in claim 1 in which said electrode is positioned axially of said liquid outlet.

6. Spray nozzle as claimed in claim 1 in which said outlet for atomizing air includes means for imparting a swirling action to the liquid emerging from said nozzle.

* * * * *

UNITED STATES PATENT AND TRADEMARK OFFICE

CERTIFICATE OF CORRECTION

PATENT NO. : 4,163,520

DATED : August 7, 1979

INVENTOR(S) : Felix Garcin et al

It is certified that error appears in the above-identified patent and that said Letters Patent is hereby corrected as shown below:

On the title page Insert:

-- (30) Foreign Application Priority Data

July 29, 1975 Switzerland 9848/75 --.

Signed and Sealed this

Tenth Day of June 1986

[SEAL]

*Attest:*

DONALD J. QUIGG

*Attesting Officer*

*Commissioner of Patents and Trademarks*